US005801335A

United States Patent [19]

Brussalis et al.

[11] Patent Number: 5,801,335

[45] Date of Patent: Sep. 1, 1998

[54] SWAGE LOCK FOR COUPLING SUBSTRATES TOGETHER

[75] Inventors: Stacy Ann Brussalis, Niles; Joseph Howard Gladd; Aaron Dillon Monroe, both of Cortland, all of Ohio

[73] Assignee: General Motors Corporation, Detroit, Mich.

[21] Appl. No.: 825,454

[22] Filed: Mar. 28, 1997

[51] Int. Cl.[6] ..... H01R 4/26

[52] U.S. Cl. ..... 174/138 G; 439/949

[58] Field of Search ..... 174/138 G, 59; 361/807, 808, 767, 742, 770; 439/291, 292, 949, 76.2

[56] References Cited

U.S. PATENT DOCUMENTS 4,689,718 8/1987 Maue et al. ..... 361/686

5,040,996 8/1991 Kobold et al. ..... 439/76.2

5,322,445 6/1994 Ozaki et al. ..... 439/212

5,563,772 10/1996 Nichols ..... 361/752

*Primary Examiner*—Kristine L. Kincaid

*Assistant Examiner*—Joseph Waks

*Attorney, Agent, or Firm*—Gary W. Brooks

[57] ABSTRACT

A first electrical insulation substrate having a pin and a second electrical insulation substrate having a hole formed therethrough for receiving the pin is provided. The pin is designed to control and limit the flow of the pin material to an upper portion of the pin during a cold forming process to avoid cracking the pin. This is accomplished by making a lower portion of the pin resistant to flow and the upper portion of the pin susceptible to flow. The lower portion of the pin may have a greater cross sectional area than the upper portion thus making the lower portion resistant to flow and the upper portion of the pin susceptible to flow.

14 Claims, 5 Drawing Sheets

SWAGE LOCK FOR COUPLING SUBSTRATES TOGETHER

TECHNICAL FIELD

This invention relates to a swage lock for fastening two substrates, and more particularly, to a swage lock for electrical components.

BACKGROUND OF THE INVENTION

Some electrical components are designed to be mated and unmated several times. However, for some electrical systems, the mating halves of the components are intended to be permanently locked together after assembly. Typically, for those systems that are intended to be permanently locked, some type of fastener is utilized and includes a high retention value to keep the mating halves together.

There are many such fasteners that are often used in the component field. Fasteners, such as screws, bolts, and rivets can be very reliable, but adding parts and labor to a composite system adds extra cost. Screws, bolts, and rivets are usually used for connectors that require a large engagement force to mate the components together, and must maintain a large retention force. There are also other ways to keep parts together permanently, such as gluing, welding, metal forming and the like. These methods are often used, but they will add costs to the overall system.

One inexpensive way to permanently assemble components is by using a press fit. Usually, there are no additional pieces because the press fit features are designed into the parts. In this press fit method, a plastic pin formed on one layer is pressed into a smaller hole formed in a second layer to create an interference fit holding the pieces together. However, this system was not ideal. The tight tolerances needed to maintain constant press fit pressure around the circumference of the pin can be problematic during production. Also, temperature conditioning could sometimes cause relaxation of the plastic, which would decrease the retention force. Hence, a more positive locking method without adding extra pieces was needed.

One such positive locking method involves cold staking or forming the pin which extends through the second layer. However, with the typical cold stake design, limited success has been obtained utilizing electrical composite materials such as polycarbonate, polysulfone, nylon and polyester, and particularly glass-filled materials. These types of materials are not capable of withstanding the significant amount of deformation and material movement and often resulted in cracked pins. While softer materials will withstand the deformation and material movement, such softer materials do not have good dimensional capability. That is, softer materials cannot provide consistently sized parts for production molding processes, or the softer materials lose their dimensions during thermal cycling of the parts. Thus, use of softer materials is not desirable.

There are other ways to minimize the amount of deformation and material movement to prevent some of the cracking associated with cold forming. One such way is to apply heat directly to the top of the pin immediately prior to the cold staking process. However, this can be costly and is a difficult process to control.

The present invention provides alternative to and advantages over the prior art.

SUMMARY OF THE INVENTION

The invention is a solution to a cracked pin problem associated with cold forming pins, and particularly pins made from glass filled materials. The solution is achieved by controlling the location of the deformation and the amount of material flow. One embodiment of the invention includes a first substrate having a pin and a second substrate having a hole formed therethrough for receiving the pin. The pin is designed to control and limit the flow of the pin material to an upper portion of the pin during the cold forming process to avoid cracking the pin. This is accomplished by making a lower portion of the pin resistant to flow and the upper portion of the pin susceptible to flow. One way to accomplish this is by designing a pin having a lower portion with a greater cross sectional area than an upper portion of the pin.

In one embodiment of the invention, the pin includes a lower tapered portion to provide stability so that the pin will not break or crack during a process of cold forming a mushroomed cap or rivet on the top of the pin. The pin includes a transition point between a smaller upper portion of the pin and the lower tapered portion of the pin. As a result, the material moves only from the transition point toward the top of the pin. The lower tapered portion remains sturdy, and material does not swage in lower tapered portion or fill the hole. As a result, only a top portion of the pin is swaged over during the cold forming process.

Preferably the hole formed through the second substrate is configured to follow the shape of the pin. The hole may be formed to have a lower tapered bore, a middle cylindrical bore and a larger cylindrical counterbore. The substrates are brought together, the pin inserted in the hole and cold formed to provide a mushroomed cap that prevents the plates from being moved or pulled apart. The structural features of the pin and the configuration of the hole prevent the pin from cracking during the cold forming process and permits the substrates, including the pin, to be made out of a variety of materials such as glass-filled plastic materials that heretofore were unsuitable for such cold forming processes.

These and other objects, features and advantages of the present invention will become apparent from the following brief description of the drawings, detailed description, and appended claims and drawings.

DESCRIPTION OF THE PREFERRED EMBODIMENT

Figure 1A:
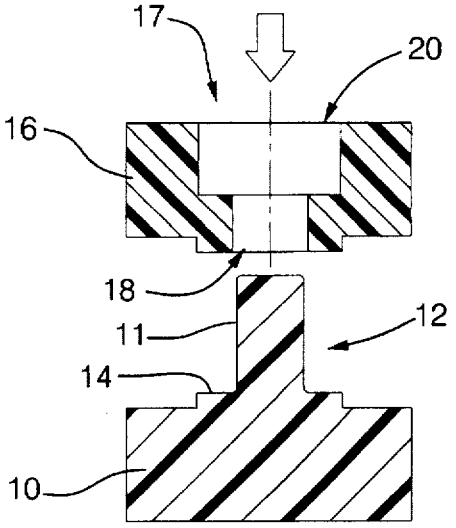
PRIOR ART FIG. 1A
FIGS. 1A–1C are cross-sectional illustrations of a prior art cold staking or forming process.
Figure 1B:
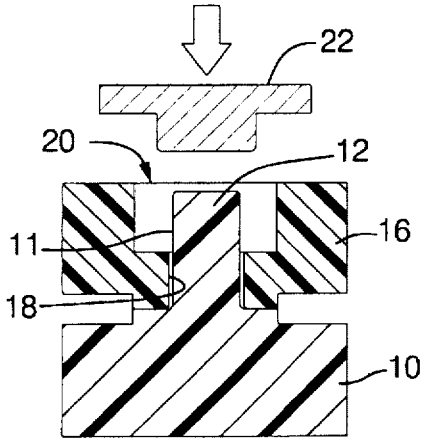
PRIOR ART FIG. 1B
Figure 1C:
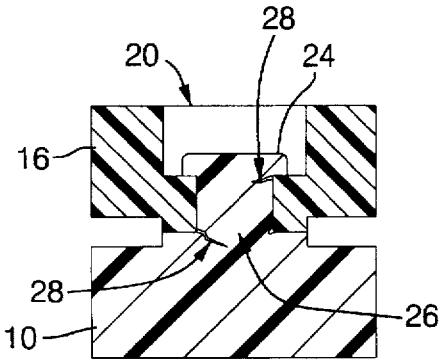
PRIOR ART FIG. 1C

The present invention and its advantages can best be appreciated by first taking a closer look at one prior art method of permanently connecting electrical components. FIGS. 1A–1C illustrate a prior art cold staking or forming process to couple two pieces together. A first substrate, in this case a plate, 10 is provided having a pin 12 with a substantially straight cylindrical wall 11 extending perpendicularly from a top surface 14 of the substrate (FIG. 1A). A second substrate, in this case also a plate, 16 is provided having an aperture 17 formed therein configured to provide little clearance for receiving the pin 12 of the first substrate 10 or in some cases configured to provide a frictional fit of the pin in the aperture. The aperture 17 includes a lower cylindrical bore portion 18 and a larger upper cylindrical counterbore 20 configured to allow the pin top to be swaged over when an anvil 22 is pressed against the top of the pin. Because there is very little clearance between the pin and the lower bore 18, any slight misalignment of the plates as they come together, especially in large plates, will result in damaged or broken pins. Referring to FIG. 1B, when the anvil 22 is pressed against the pin 12, material moves in a lateral direction to fill up the entire lower bore 18. As a result, less material is available at the top or upper portion of the pin for the swaged-over (cap) portion 24. The cap 24 on the top will be smaller and more likely to break, unless the pin is made much taller. Since the material fills up the entire lower bore 18 first, stress concentrations increase at the base 26 of the pin which often will result in cracking (cracks 28) at the cap or the base, especially when about 10–35 weight percent or more glass-filled plastics or other insulation materials are utilized for the substrate plates 10, 16. An electrical insulation material for the substrates may include a polymer based material such as polycarbonate, polysulfone, nylon and polyester, which may include glass materials preferably more than 30 weight percent, about 10–35 weight percent, and more preferably 30–35 weight percent glass materials, and mixtures thereof. A preferred insulation material is a polyester with 33 weight percent glass beads.

Figure 2A:
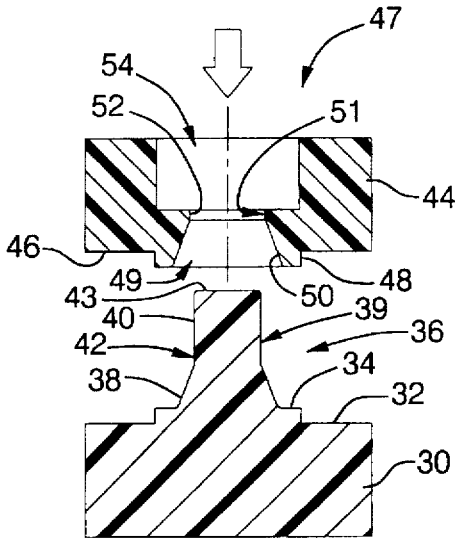
FIGS. 2A–2C are cross-sectional illustrations of a cold staking or forming process according to the present invention.
Figure 2B:
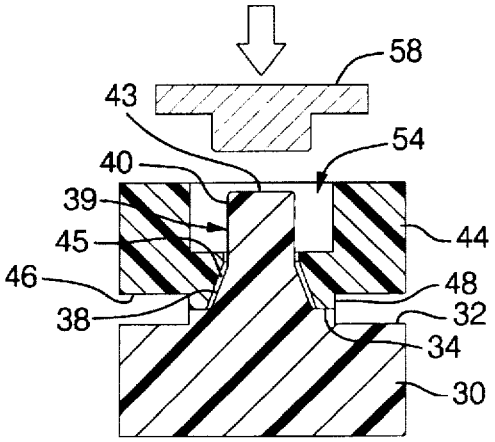
Figure 2C:
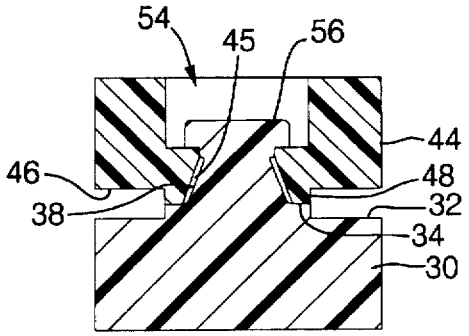

FIGS. 2A–2C illustrate a method of coupling two pieces together according to the present invention. Although plates are illustrated, the invention is not limited to plates and is applicable to substrates of a variety of configurations.

According to the present invention, a first substrate, in this case a plate, 30 is provided having a top surface including a substantially flat portion 32 (FIG. 2A). Preferably, the flat portion 32 of the top surface is on one of four end rails on an insulation plate of an electrical distribution center which is described in greater detail hereafter. An annular stand-off or stand-offs 34 are provided extending upwardly from the top surface 32. A pin 36 is provided on the stand-offs 34 and includes a lower, preferably tapered portion 38, which may be frusto-conical or frustum-like in configuration. The pin also includes an upper portion 39 having a substantially straight wall 40, preferably cylindrical in configuration. The wall 40 extends in a substantially perpendicular direction to the plane of the flat portion 32 of the top surface of the substrate. A transition point 42 is located at the juncture of the lower tapered portion 38 and the substantially straight wall 40 of the pin. Although the lower portion 38 of the pin is preferably tapered, any design resulting in a lower portion with a greater cross-sectional area will limit the flow of material to the upper portion 39 of the pin. For example, a block-like structure with a constant and consistent diameter or width that is greater than that of the upper portion 38 is within the scope of the invention. However, designs with sharp corners may be less desirable because stress tends to concentrated in the corner areas resulting in cracks or breakage.

Referring to FIG. 2A, a second substrate, in this case a plate, 44 is provided having a flat portion of a bottom surface 46. An annular stand-off or stand-offs 48 extend outwardly from the bottom surface 46 of the second plate. A hole or aperture 47 is formed through the second plate at a location near the stand-offs 48. The aperture 47 includes a lower tapered bore portion 49 defined by a side wall 50 formed at an angle to the flat portion of the bottom surface 46 of the second plate. The aperture 47 also includes a middle bore 51 portion defined by a side wall 52 running substantially perpendicularly to the flat portion of the bottom surface 46 of the second substrate. A larger cylindrical counterbore 54 is provided above and communicates with the middle bore 51 and is constructed and arranged to provide sufficient space to swage the top of the pin over to form a mushroomed cap 56 (FIG. 2C).

Referring to FIG. 2B, a significant amount of lead-in is provided because the top of the pin 43 has a width less than the lower tapered bore 49. This prevents pin breakage during assembly, if misalignment were to occur between the two plates 30, 44. The two plates 30, 44 are brought together with the pin 36 entering the aperture and extending into the counterbore 54. Next, a press or anvil 58 pushes against the top of the pin 43 to cold form the pin to provide a mushroomed cap 56 shown in FIG. 2C.

Figure 3A:
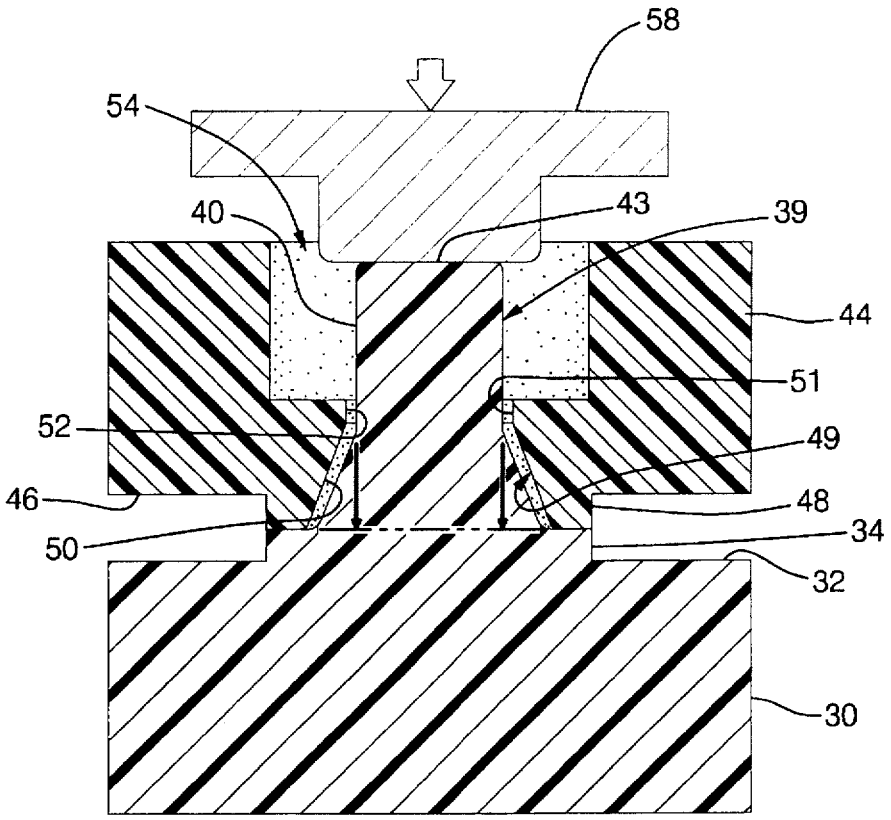
FIG. 3A is an enlarged view of FIG. 2B.
Figure 3B:
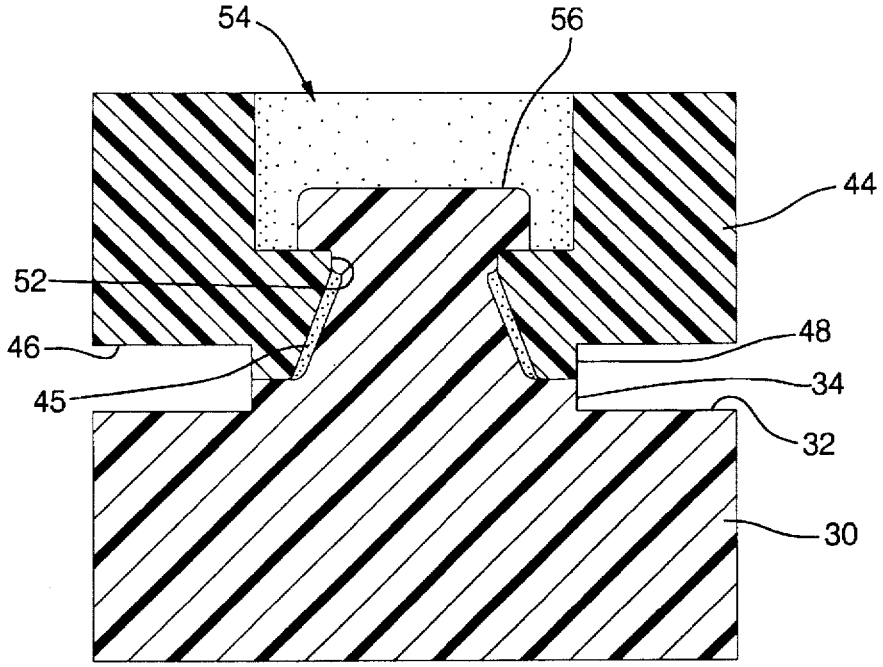
FIG. 3B is an enlarged view of FIG. 2C.

The exact mechanism or principle upon which the present invention operates is unknown. However, referring to FIG. 3A, it is believed that when the anvil 58 is pressed against the top of the pin 43, a downward force is exerted on the pin 36 along the lines shown in FIG. 3A that are parallel to the longitudinal axis of the pin. The pin material moves in a downward direction until resistance is met which normally occurs at the base of this pin illustrated by the phantom line in FIG. 3A. Thereafter material would move in a direction that provides the least resistance which would be laterally for a cylindrical pin 12 of the prior art. However, for the present invention, there is a sufficient amount of material in the tapered section extending laterally outwardly from a line tangent to the straight wall portion 40 of the pin, to provide sufficient resistance to lateral movement of material at the base of the pin. As a result, the material moves in a lateral direction only from the transition area 42 toward the top of the pin 43 until the material fully engages the straight wall 52 defining the middle bore 51 (FIG. 3B). Because material does not move laterally to fill the lower tapered bore 49, more material is available near the top of the pin to be swaged over. When more material is available near the top of the pin to be swaged over, cracking is greatly reduced or eliminated.

Due to the shape of the first plate 30 and the aperture 47 in the second plate, the pin 36 is more sturdy, and about 10–29, 30–35 weight percent glass-filled material, or more, may be included in the plastic material. Because the swaging over of the plastic provides the locking feature required, it is no longer necessary to provide a press fit along the sides of the pin and the hole as was the case with the prior art. In fact, making the pin diameter or cross section slightly smaller than the aperture diameter-cross section after the two plates come together, eases the assembly of the parts.

The stand-offs 34 and 48 provided between the flat portion of the top surface 32 of the first plate and the flat portion of the bottom surface 46 of the second plate ensures that the pin 36 protrudes through the aperture 47 to the same height every time. This is particularly advantageous for bussed electrical centers wherein the stamped metal busing is used and placed between the plates. Preferably, the stand-off 48 on the second plate 44 bottoms out on the stand-off 34 on the first plate so that a slight gap 45 is provided between the pin 36 and the walls 50, 52 defining the lower tapered bore 49 and the middle bore 51.

Although the present invention is useful in a variety of products, it is particularly useful in electrical distribution centers. Electrical distribution centers are currently being widely used in automobiles. The electrical distribution center is simply a central junction block system designed as a stand-alone assembly. This junction block can package various fuses, relays and electronic devices in a single location. The electrical distribution center not only reduces cost by consolidating these various functions into one block, but they also reduce the number of cut and spliced leads which helps to increase reliability. Due to the increase in electrical content in automobiles, the electrical distribution centers are becoming larger and more expensive. Prior electrical distribution centers had heretofore utilized insert molded buss layers which account for a substantial percentage of the cost of the entire electrical distribution center. An electrical distribution center with a swage lock according to the present invention will now be described.

Figure 4:
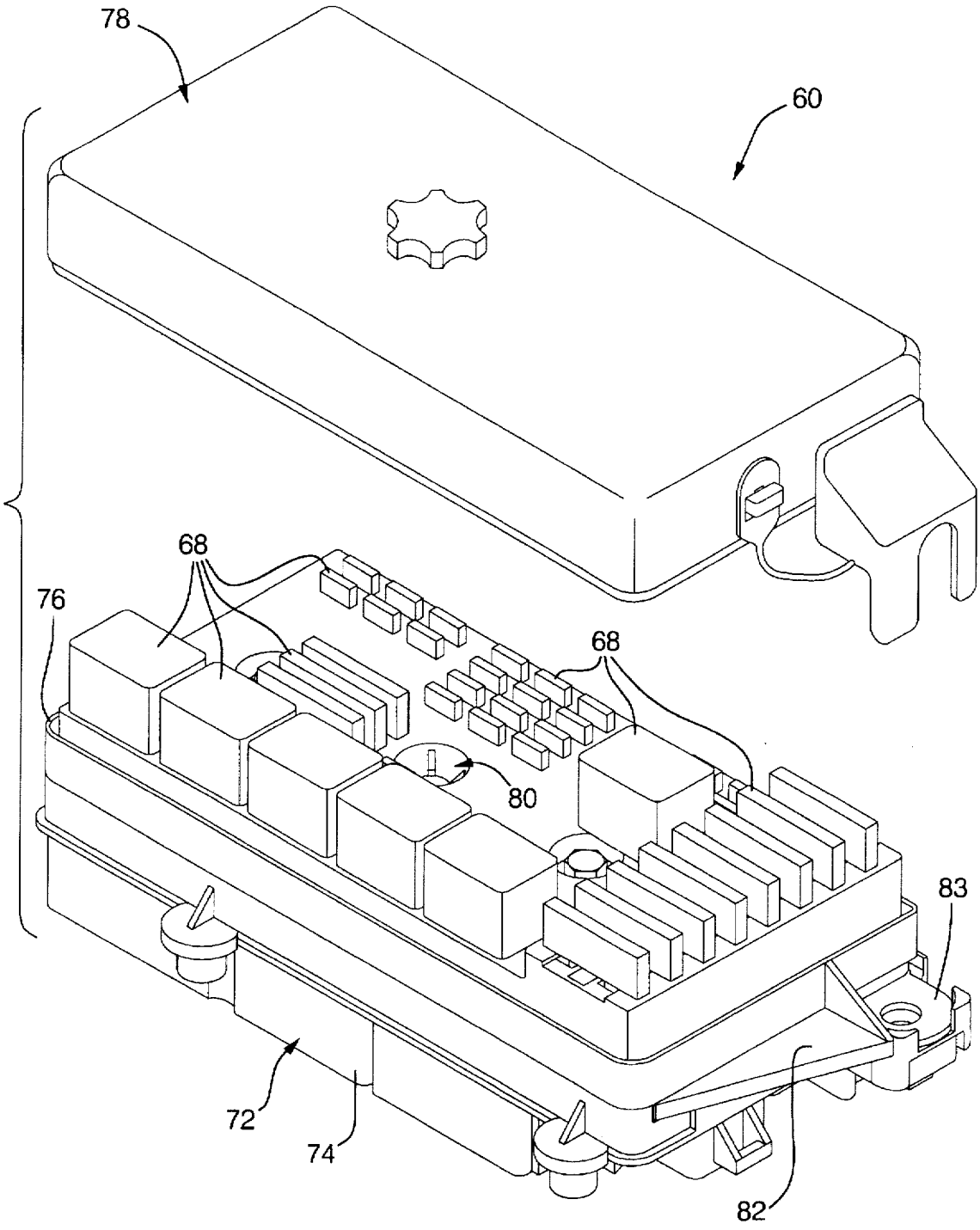
FIG. 4 is a partially exploded view of a buss electrical center with the cover removed and having an insulation subassembly according to the present invention.
Figure 5:
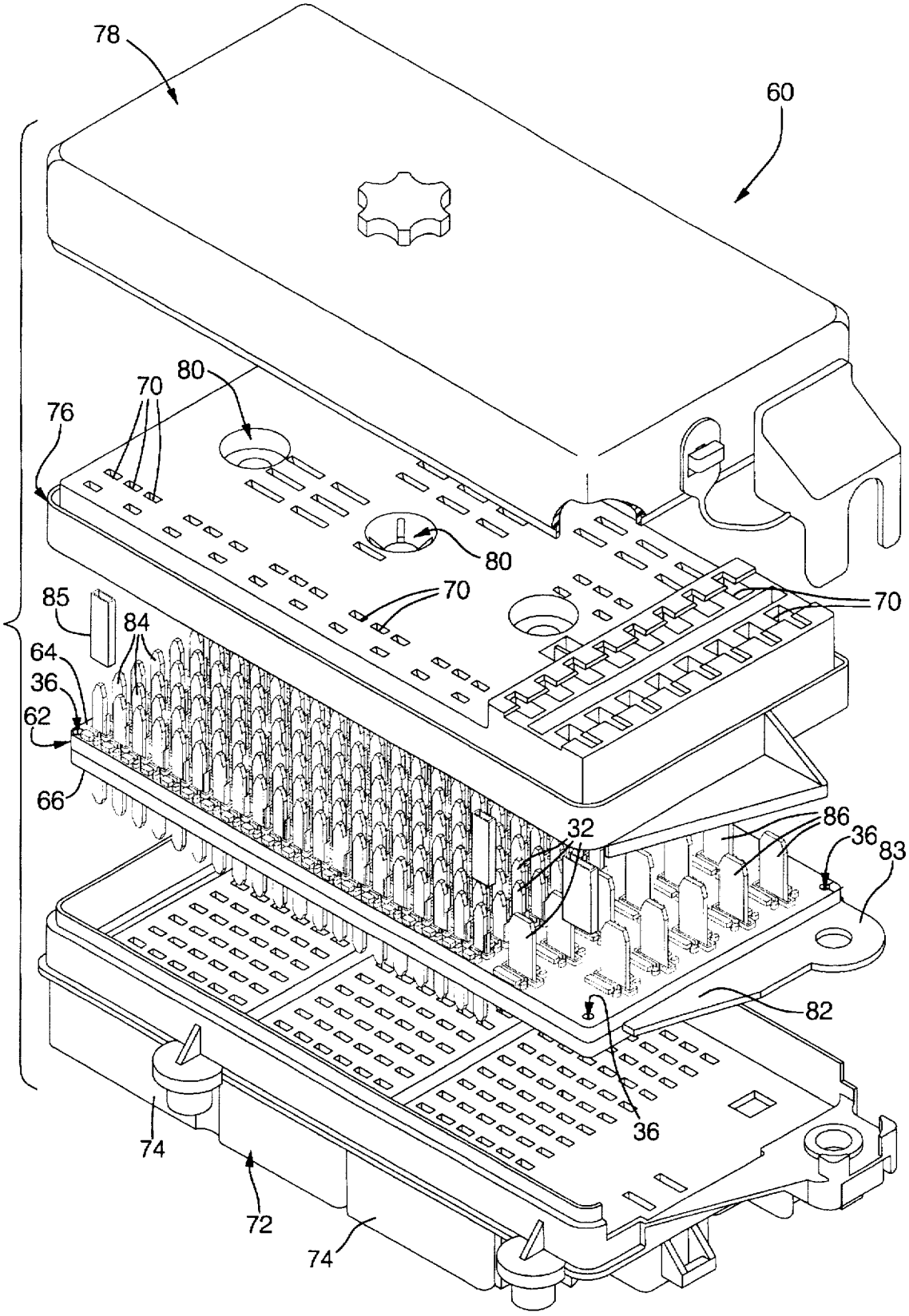
FIG. 5 is a partially exploded view of a buss electrical center showing an insulation subassembly according to the present invention.

Referring to FIGS. 4–5, an electrical distribution center provides an electrical interconnect between electrical and electronic devices 68 such as mini-fuses, maxi-fuses and relays that are put into slots 70 (shown in FIG. 5) extending through an upper housing 76 of the electrical distribution center 60 and the electrical connectors of wire harnesses (not shown) that are plugged into a plurality of connector sockets 72 in a lower housing 74 of the electrical distribution center.

The upper housing 76 and the lower housing 74 and a cover 78 are molded from a thermal plastic electrical insulation material. The connector sockets 72 for receiving electrical connectors of the wire harness utilized in automotive applications can be molded as an integral part of the lower housing 74. Mini-fuses, maxi-fuses, devices and relays 68 can be put into terminal cavities or slots 70 (shown in FIG. 5) in the upper housing 76 and held in place by the cover 78 when the cover is attached to the housings using bolts (not shown) extending through holes 80 formed in the housings 74, 76 and/or cover 78.

Referring to FIG. 5, an electrical distribution center 60 according to the present invention includes a two-piece main insulation assembly 62 which includes an upper half insulation plate 64 and a lower half insulation plate 66 made of a plastic, polymer, glass-filled plastic or other electrical insulation material. The two insulation plates 64, 66 are held together using a swage lock pin 36 according to the present invention. Other features of the electrical distribution center are disclosed in U.S. Ser. No. 08/689,619 Brussalis et al, entitled "Electrical Distribution Center with Two-Piece Insulation Assembly" filed Aug. 12, 1996, the disclosure of which is hereby incorporated by reference and is generally described hereinafter.

Figure 6:
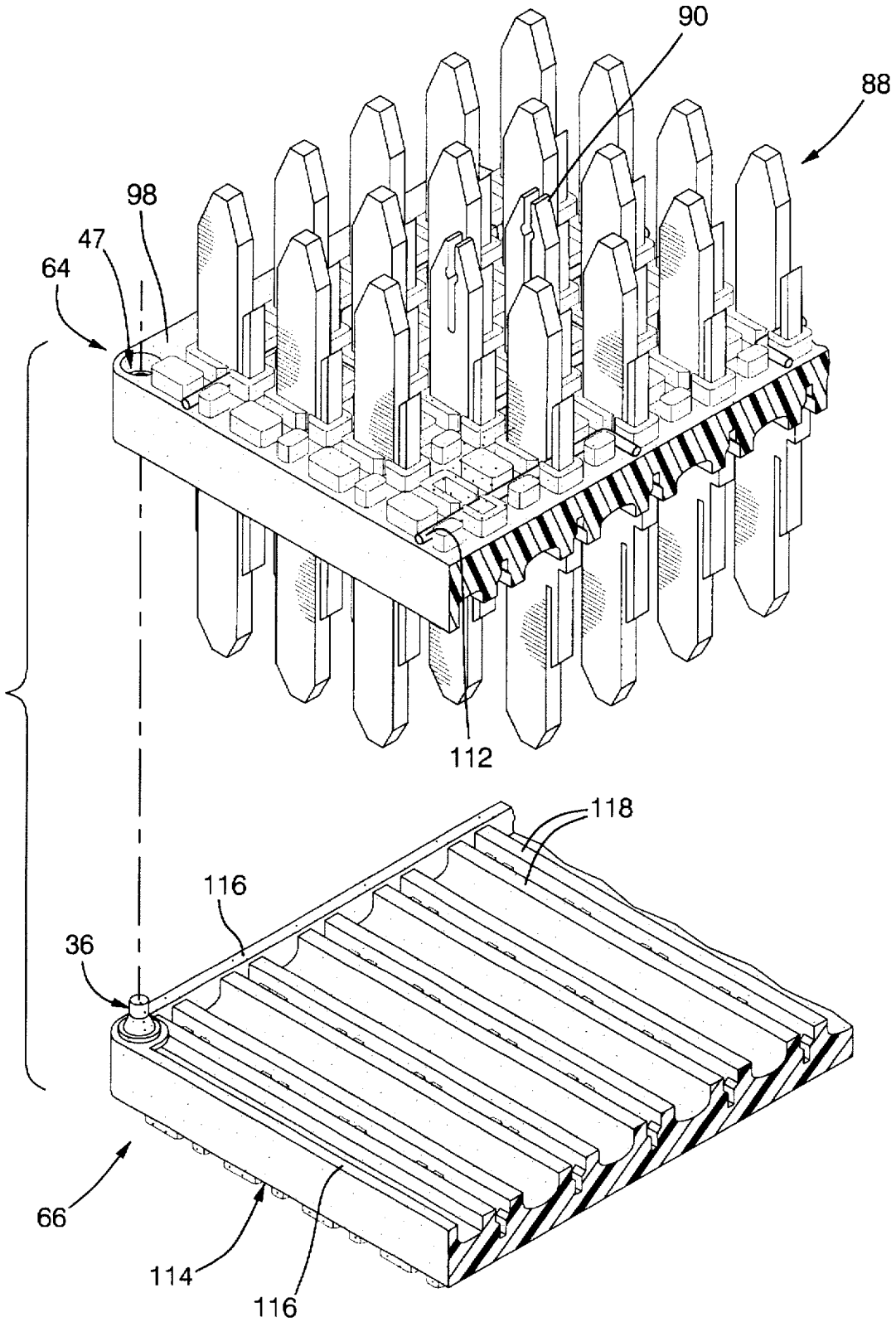
FIG. 6 is an enlarged, partially exploded view of the insulation subassembly of FIG. 5.

The electrical distribution center includes several components that are disposed within the housing as will be appreciated from FIGS. 4–6. This includes the two-piece main insulation assembly 62 having the upper and lower insulation plate halves 64, 66. The main stamped metal buss circuit 82 comprises a flat planar body that is carried in a gap between the upper and lower insulation plate halves 64, 66 for interconnecting a plurality of small and larger terminals 84, 86 that are perpendicularly attached at the edge of the body of the stamped metal buss 82, or extend through slots in the body of the stamped metal buss 82, or are stitched into the insulation halves 64, 66 and connected by wire routing 112 (FIG. 6). In any event, the main buss plate 82 comprises one or more stamped metal circuit components having male blade or tuning fork terminals 84, 86 arranged in a predetermined pattern and maintained in this predetermined pattern by the two-piece insulation assembly. The stamped metal circuit components 84, 86 have a relatively high current capacity and thus are adequate for even the highest current normally encountered in automotive wire circuits. The main stamped metal circuit component 82 is a power buss and includes an ear portion 83 for connection to a battery cable. A female-female adapter 85 may be used to provide an electrical connection between electronic devices 68 and male terminal blades 88 described hereafter.

Referring to FIG. 6, the underside of at least one of the halves 64, 66 of the insulation assembly includes a pair of parallel side rails 116 wherein one pair of side rails 116 runs perpendicular to the other pair of side rails. A plurality of beams 118 extending between the side rails 116 and each beam 118 for receiving male or tuning fork terminals 88, 90 therebetween.

As shown in FIG. 6, a plurality of pins 36 according to the present invention extend upwardly from the rails 116 at selected locations of the first electrical insulation half to be received in and through corresponding holes 47 formed in the second electrical insulation half and are swaged over to provide a mushroomed cap that locks the plates together according to the present invention and vice versa. Naturally, a plurality of pins 36 and holes 47 can be used on both insulation halves 64, 66.

We claim:

1. A product comprising:

a first and second substrate;

said first substrate having a pin extending from a surface, the pin having a middle portion including a first substantially straight wall, a lower tapered portion extending from the middle portion toward the surface of the first substrate, and a cold formed mushroomed cap extending from the middle portion;

the second substrate having an aperture formed therethrough, the aperture being formed to have a middle bore portion defined by a second substantially straight wall of the second substrate constructed and arranged to receive the middle potion of the pin, a lower tapered base portion of the aperture partially defined at least by a tapered wall of the second substrate extending from the straight wall of a second substrate, and an upper counter-bore portion of the aperture communicating with the middle bore portion and having a width greater than the middle bore portion and constructed and arranged to receive the cold formed cap of the pin, and wherein said first and second substrates are constructed and arranged to be fastened together by the pin.

2. A product as set forth in claim 1 wherein said first substrate comprises a plastic filled with about 10–35 weight percent glass materials.

3. A product as set forth in claim 1 wherein said first substrate comprises more than 30 weight percent glass materials.

4. A product as set forth in claim 1 further comprising a plurality of pins connected to the first substrate and a plurality of apertures formed through said second substrate.

5. A product as set forth in claim 4 further comprising an additional plurality of pins extending from said second substrate and an additional plurality of apertures formed through said first substrate.

6. A product as set forth in claim 1 further comprising a stand-off extending outwardly from said tapered portion of the pin.

7. A product as set forth in claim 1 further comprising a stand-off adjacent the lower tapered base portion of the aperture formed in the second substrate.

8. A product as set forth in claim 1 wherein the lower tapered portion of the pin has a first end connected to the middle portion and a second end having a diameter greater than the diameter of the first end.

9. A product as set forth in claim 1 further comprising a buss plate having at least a portion sandwiched between said first and second substrates.

10. A product as set forth in claim 1 further comprising an electrical terminal extending through at least one of the first and second substrates.

11. A product as set forth in claim 10 wherein said electrical terminal is a tuning fork terminal.

12. A product as set forth in claim 11 further comprising an electrical device having a male blade inserted into the tuning fork terminal.

13. A product as set forth in claim 12 wherein said electrical device comprises at least one of a fuse, relay, and maxi-fuse.

14. A product as set forth in claim 1 wherein said first substrate comprises a material selected from the group consisting of: polymer based materials, polymer based materials filled with glass, polycarbonates, polysulfones, nylons, polyesters, glass filled materials and mixtures thereof.

* * * * *